US011536089B2

(12) United States Patent
Camurdan et al.

(10) Patent No.: US 11,536,089 B2
(45) Date of Patent: Dec. 27, 2022

(54) HYDRAULIC DRIVE IN FRONT OF A DRILLING APPARATUS

(71) Applicant: Robert Bosch GmbH, Stuttgart (DE)

(72) Inventors: Hakan Camurdan, Neu-Ulm (DE); Hermann Schuele, Elchingen (DE); Michael Schuette, Langenau (DE); Ulrich Schill, Ulm (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/396,237

(22) Filed: Aug. 6, 2021

(65) Prior Publication Data

US 2022/0042375 A1 Feb. 10, 2022

(30) Foreign Application Priority Data

Aug. 10, 2020 (DE) ..... 10 2020 210 093.4

(51) Int. Cl.
*E21B 4/02* (2006.01)
*E21B 7/04* (2006.01)

(52) U.S. Cl.
CPC ..... *E21B 4/02* (2013.01); *E21B 7/046* (2013.01)

(58) Field of Classification Search
CPC ..... E21B 4/02
See application file for complete search history.

(56) References Cited

FOREIGN PATENT DOCUMENTS

| | | |
|---|---|---|
| DE | 44 25 130 A1 | 2/1995 |
| DE | 44 10 404 A1 | 10/1995 |
| DE | 10 2011 121 052 A1 | 6/2013 |

OTHER PUBLICATIONS

English Translation of DE4425130 (Year: 1995).*
Prime Drilling GMBH: Prime Drilling—So funktioniert Horizontalbohrtechnik, Feb. 2012, Screenshot. URL:https://www.youtube.com/watch?v=Z4Jsp0LqV_E. Retrieved on Nov. 16, 2020. (1 page).
Bosch Rexroth AG, Data Sheet, Axial piston variable pump A4VG Series 40, RE 92004, Mar. 2020 (68 pages).

* cited by examiner

*Primary Examiner* — Giovanna Wright
(74) *Attorney, Agent, or Firm* — Maginot, Moore & Beck LLP

(57) ABSTRACT

A hydraulic drive for a drilling apparatus includes a hydraulic motor that drives a drill and is connected to a main pump via a first and a second working line in a closed hydraulic circuit. The main pump has a steplessly adjustable displacement volume that is adjustable by an actuating cylinder that is connected to a control valve, which has a first feed connector and a first return connector. The first feed connector is connected to an outlet connector of a pressure reducing valve such that the pressure at the feed connector is adjustable to a predefined setpoint pressure by means of the pressure reducing valve. The setpoint pressure is set in a manner which is dependent on a desired high pressure in the closed circuit.

12 Claims, 1 Drawing Sheet

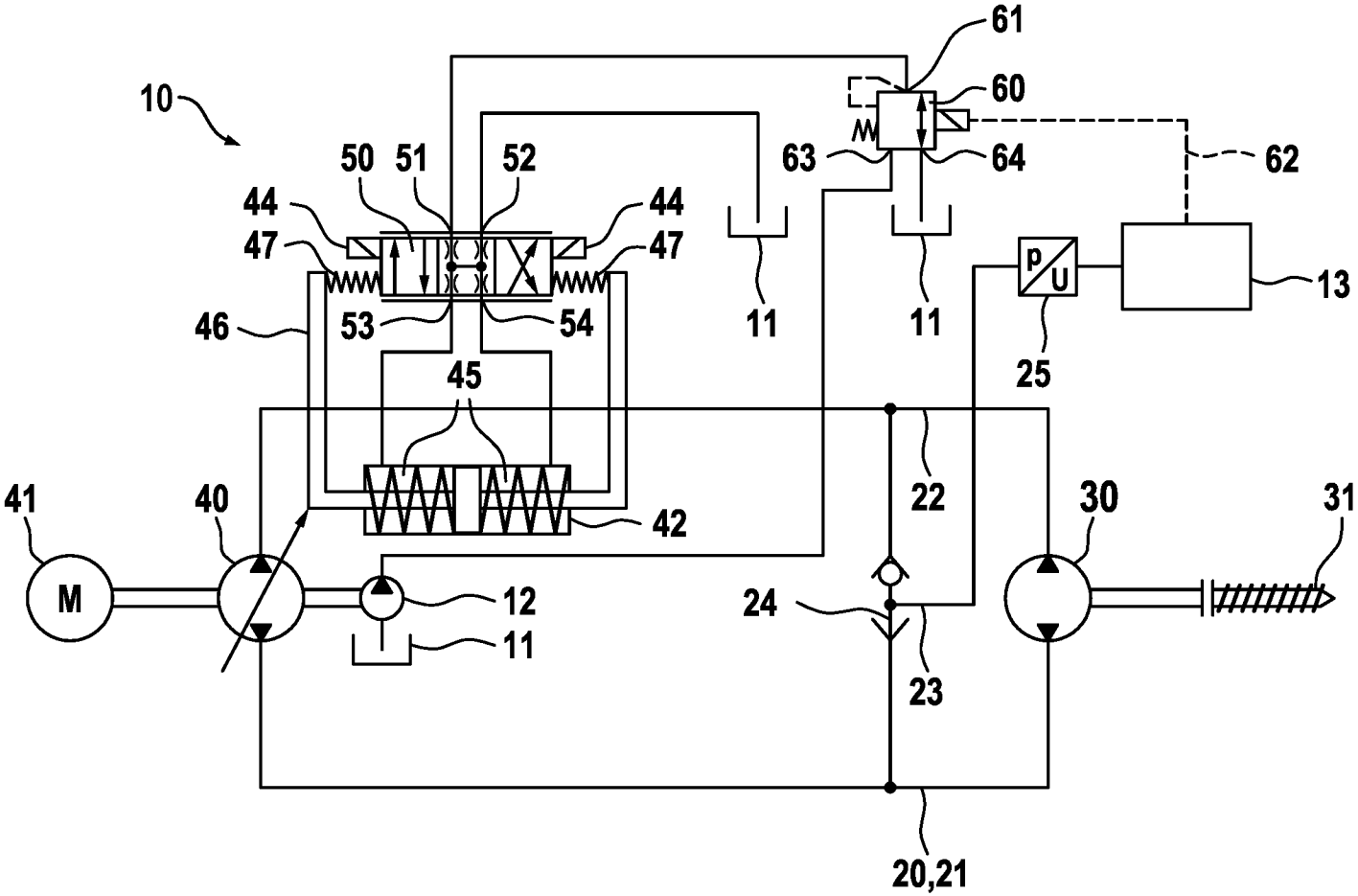
10
11
11
12
13
20,21
22
23
24
25
30
31
40
41
42
44
44
45
46
47
47
50
51
52
53
54
60
61
62
63
64
P
U
M

HYDRAULIC DRIVE IN FRONT OF A DRILLING APPARATUS

This application claims priority under 35 U.S.C. § 119 to application no. DE 10 2020 210 093.4, filed on Aug. 10, 2020 in Germany, the disclosure of which is incorporated herein by reference in its entirety.

The disclosure relates to a hydraulic drive, and to a method for the operation of the hydraulic drive.

BACKGROUND

The hydraulic drive is provided primarily for use with a horizontal drilling machine, as is explained, for example, in the video which could be retrieved on 16.07.2020 using the Internet link https://www.youtube.com/watch?v=Z4Jsp0LgV_E.

Furthermore, the data sheet which could be retrieved on 16.07.2020 using the Internet link https://boschrexroth.com/various/utilities/mediadirectory/download/index.jsp?object_nr=RD 92004 has disclosed an axial piston pump of swash plate design which has a steplessly adjustable displacement volume. It is provided for use in a closed hydraulic circuit. The control valve which is shown in the FIGURE of the present application is covered in the said data sheet in the chapter "EP—electric proportional adjustment". It makes closed loop control of the rotational speed of the hydraulic motor which is connected to the pump in the closed hydraulic circuit possible in a proportional manner with respect to an actuating signal. In contrast, the corresponding torque cannot be influenced.

SUMMARY

One advantage of the present disclosure consists in that the torque of the hydraulic motor can be set in a manner which is targeted and dependent on the operating state of the hydraulic drive. Here, in the case of a horizontal drilling machine, the operating states of advancing of the drill and changing of the drill or an individual part of the drill pipe are to be mentioned, in particular.

It is proposed according to the disclosure that the first feed connector of the control valve is connected to an outlet connector of a pressure reducing valve, with the result that the pressure at the feed connector can be adjusted to a predefined setpoint pressure by means of the pressure reducing valve, it being possible for said setpoint pressure to be set in a manner which is dependent on a desired high pressure in the closed circuit.

The control valve preferably has a first and a second working connector which are connected in each case to one of two actuating chambers of the actuating cylinder which act in opposite directions. The hydraulic motor preferably has a constant displacement volume, with the result that the torque is dependent substantially solely on the said high pressure. The hydraulic drive is preferably operated by way of a pressure fluid in the form of a liquid, very highly preferably by way of hydraulic oil. The high pressure is to be understood to mean the higher pressure of the two pressures in the first and the second working line.

Advantageous developments and improvements of the disclosed hydraulic drive are specified herein.

It can be provided that the pressure reducing valve is attached directly to the control valve. As a result, pipe or hose lines between the control valve and the pressure reducing valve can be avoided.

It can be provided that the control valve is configured in such a way that the displacement volume of the main pump is adjusted in a manner which is substantially proportional to an associated actuating signal. The actuating signal can be an electric or hydraulic signal. It goes without saying that this closed loop control is fully effective only when a sufficiently high pressure is provided at the first feed connector by way of the pressure reducing valve according to the disclosure.

It can be provided that the pressure reducing valve is supplied with pressure fluid by a separate auxiliary pump. The auxiliary pump is, for example, an external gear pump. The auxiliary pump is preferably operated in an open hydraulic circuit, the said auxiliary pump sucking in the pressure fluid from a tank. It is conceivable for the high pressure of the closed hydraulic circuit of the main pump to be used in order to supply the pressure limiting valve.

It can be provided that the first return connector of the control valve and/or a second return connector of the pressure reducing valve are/is connected to a tank.

It can be provided that the high pressure is determined by means of a shuttle valve which is connected on the input side to the first and the second working line of the closed hydraulic circuit. In the case of advancing of the drill and in the case of releasing of the drill or the individual parts of the drill pipe, the high pressure prevails in each case in another working line because the rotational direction of the hydraulic motor is reversed in the said operating states. The high pressure prevails on the outlet side at the shuttle valve, regardless of which operating state the hydraulic drive is in. The high pressure is preferably measured by means of a pressure sensor.

It can be provided that it is possible for the displacement volume of the main pump to be adjusted in such a way that the conveying direction of the main pump can be reversed, in the case of a constant drive rotational direction, solely by way of adjustment of the displacement to volume. In this way, an internal combustion engine, in particular a diesel engine, the rotational direction of which cannot be readily reversed, can be used as a drive motor without problems.

It can be provided that it is possible for the setpoint pressure of the pressure reducing valve to be adjusted electrically. The setpoint pressure is preferably set by means of an electromagnet which very highly preferably adjusts the prestress of a spring which loads a control slide of the pressure reducing valve.

A control loop can be provided, the actual variable of which is the measured high pressure, the actuating variable of the said control loop being the setpoint pressure of the pressure reducing valve, the setpoint variable of the said control loop being the desired high pressure. The said actual variable is preferably measured by way of a pressure sensor. The said control loop preferably comprises a steady, linear controller which is very highly preferably implemented in a time-discrete manner. The controller is, for example, a P-type controller or a PI-type controller. It is very highly preferably implemented by a control apparatus which comprises a digital computer.

In addition, the disclosure includes a method for operating a hydraulic drive described herein, different high pressures being set in the case of a change of the drill and in the case of advancing of the drill by way of adjustment of the setpoint pressure of the pressure reducing valve. In the case of a horizontal apparatus, a drill pipe is typically used which is composed of a plurality of individual parts which are screwed to one another. The screw connection is designed in such a way that it is tightened during advancing. In the case of a change of an individual part of the drill pipe, the drill is driven with a reversed rotational direction in comparison with the advancing, a higher torque typically being required in order to release the said screw connection than in the case of advancing. Accordingly, in the case of the change of the drill, a higher high pressure is preferably set than in the case of advancing of the drill.

It goes without saying that the features which are mentioned in the above text and are still to be explained in the following text can be used not only in the respective specified combination, but rather also in other combinations or on their own, without departing from the scope of the present disclosure.

BRIEF DESCRIPTION OF THE DRAWINGS

The disclosure will be explained in greater detail in the following text on the basis of the appended drawing, in which:

The FIGURE shows a circuit diagram of a hydraulic drive according to the disclosure.

DETAILED DESCRIPTION

The FIGURE shows a circuit diagram of a hydraulic drive 10 according to the disclosure. The hydraulic drive 10 serves to drive a drill 31 which is used, for example, in a horizontal drilling machine. The drill 31 is configured, for example, as a drill pipe which is assembled from a plurality of individual parts which are screwed to one another. During the advancing of the drill 31, it is supplemented gradually by individual parts so as to lengthen the borehole. The borehole serves, for example, for electric lines to be guided through below an existing street.

The hydraulic drive 10 comprises a main pump 40 and a hydraulic motor 30 which are connected via a first and the second working line 21; 22 in a closed hydraulic circuit 20. The closed hydraulic circuit 20 is simplified greatly in the FIGURE, details which are not required for the comprehension of the disclosure having been omitted. These details are, for example, safeguarding against overpressure and flushing in order to avoid overheating of the pressure fluid. The hydraulic drive 10 is operated by way of a pressure fluid, which is preferably a liquid and very highly preferably hydraulic oil.

The main pump 40 has a steplessly adjustable displacement volume. It is preferably configured as an axial piston pump of swash plate design. The swash angle of the corresponding swash plate is adjusted by means of an actuating cylinder 42, in order to adjust the displacement volume. The main pump 40 can be adjusted beyond the displacement volume zero, with the result that the conveying direction can be reversed solely by way of adjustment of the displacement volume or the swash plate, without the drive rotational direction of the drive motor 41 being reversed. In the case of a horizontal drilling machine, the drive motor 41 is usually configured as an internal combustion engine, in particular as a diesel engine.

The hydraulic motor 30 preferably has a constant displacement volume, with the result that its torque is dependent substantially solely on the high pressure 23 of the closed hydraulic circuit 20. The hydraulic motor 30 is configured, for example, as an axial piston motor of swash plate design.

In the present case, the actuating cylinder 42 is configured as a double-acting cylinder which has two actuating chambers 45 which bring about an adjustment of the displacement volume in opposite directions. The two actuating chambers 45 are connected in each case to a first and a second actuating connector 53; 54 of the control valve 50. The control valve 50 is configured as a steplessly adjustable 4/3-way valve. Here, the middle switching position symbolizes a positive zero overlap, in the case of which the first feed connector 51 and the first return connector 52 are connected in each case via a very small opening cross section to the first and the second actuating connector 53; 54. This results in a favorable control behavior of the control valve 50.

The control valve 50 implements closed loop control, in the case of which the displacement volume of the main pump 40 is adjusted substantially proportionally to an actuating signal 44, the actuating signal 44 being predefined in the present case by means of two electromagnets which act in opposite directions on the control slide of the control valve 50. The position of the actuating cylinder 42 is fed back to the said control slide via springs 47 via a (symbolically shown) travel feedback means 46. Here, the position of the actuating cylinder 42 is proportional to the force which the springs 47 exert on the control slide. If the control slide is situated in force equilibrium, the displacement volume is adjusted to the value which is predefined by way of the actuating signal 44.

The first feed connector 51 of a control valve 50 of this type is usually connected to a defined high pressure. According to the disclosure, the first feed connector 51 is connected to a pressure reducing valve 60, in particular to its outlet connector 61. The higher of the two pressures at the first and at the second actuating connector 53; 54 cannot rise above the pressure at the first feed connector 51. At the same time, an actuating pressure which is dependent on the high pressure 23 in the first or the second working line 21; 22 is required for the adjustment of the displacement volume. If the said required actuating pressure does not prevail at the first feed connector 51, the displacement volume of the main pump 40 is decreased, as a result of which the high pressure 23 drops. Here, the high pressure 23 is to be understood to mean the higher of the two pressures in the first and the second working line 21; 22. In the present case, the high pressure 23 is determined by way of a shuttle valve 24.

In accordance with the above statements, the high pressure 23 can therefore be influenced by way of the pressure reducing valve 60. It goes without saying here that the control function of the control valve 50 is disrupted here, the displacement volume of the main pump 40 no longer necessarily being proportional to the actuating signal 44. This is the case only when the pressure reducing valve 60 provides a pressure at the first feed connector 51 for this purpose, which pressure is high enough.

Since the relationship between the pressure at the first feed connector 51 and the high pressure 23 is subject to a wide variety of influences, the high pressure 23 is measured by means of the pressure sensor 25. An electronic control apparatus 13 then sets the setpoint pressure 62 of the pressure reducing valve 60 in such a way that the measured high pressure 23 is equal to a desired high pressure. Here, the desired high pressure is selected in a manner which is dependent on the operating state of the drilling apparatus. In the case of advancing of the drill, the desired high pressure is typically somewhat lower than in the case of exchanging of an individual part of the drill pipe. This takes into account the fact that the screw connections of the drill pipe are tightened in the case of advancing, with the result that an increased torque is required in order to release the screw connection.

In the present case, the pressure reducing valve 60 is supplied with pressure fluid from an auxiliary pump 12. The auxiliary pump 12 sucks pressure fluid from a tank 11 and conveys it to a second feed connector of the pressure reducing valve 60. A second return connector of the pressure reducing valve 60 is connected to the tank 11. All the tank symbols in the FIGURE denote the same tank 11. The first return connector 52 of the control valve 50 is likewise connected to the tank 11.

The control apparatus 13 preferably comprises a programmable digital computer.

LIST OF REFERENCE NUMERALS

10 Hydraulic drive
11 Tank
12 Auxiliary pump
13 Control apparatus
20 Closed circuit
21 First working line
22 Second working line
23 High pressure
24 Shuttle valve
25 Pressure sensor
30 Hydraulic motor
31 Drill
40 Main pump
41 Drive motor
42 Actuating cylinder
44 Actuating signal
45 Actuating chamber
46 Travel feedback means
47 Spring
50 Control valve
51 First feed connector
52 First return connector
53 First actuating connector
54 Second actuating connector
60 Pressure reducing valve
61 Outlet connector
62 Setpoint pressure
63 Second feed connector
64 Second return connector

The invention claimed is:

1. A hydraulic drive for a drilling apparatus, comprising:
a hydraulic motor configured to drive a drill;
a main pump to which the hydraulic motor is connected in a closed hydraulic circuit via a first working line and a second working line, the main pump having a displacement volume that is steplessly adjustable;
an actuating cylinder configured to adjust the displacement volume of the main pump;
a control valve connected to the actuating cylinder, the control valve having a first feed connector and a first return connector; and
a pressure reducing valve having an outlet connector to which the first feed connector is connected;
wherein the pressure reducing valve is configured to set a pressure at the first feed connector to a predefined setpoint pressure, and the hydraulic drive is configured such that the predefined setpoint pressure is set based on a desired high pressure in the closed hydraulic circuit.

2. The hydraulic drive according to claim 1, wherein the pressure reducing valve is attached directly to the control valve.

3. The hydraulic drive according to claim 1, wherein the control valve is configured such that the displacement volume of the main pump is adjusted in a manner which is substantially proportional to an associated actuating signal.

4. The hydraulic drive according to claim 1, wherein the pressure reducing valve is supplied with pressure fluid by a separate auxiliary pump.

5. The hydraulic drive according to claim 1, wherein the first return connector of the control valve and/or a second return connector of the pressure reducing valve is connected to a tank.

6. The hydraulic drive according to claim 1, further comprising:
a shuttle valve having an input side connected to the first and second working lines of the closed hydraulic circuit and configured to determine a measured high pressure in the closed hydraulic circuit.

7. The hydraulic drive according to claim 1, wherein the main pump is configured such that a conveying direction of the main pump is reversible, in the case of a constant drive rotational direction, solely by way of adjustment of the displacement volume.

8. The hydraulic drive according to claim 1, wherein the pressure reducing valve is configured such that the predefined setpoint pressure is electrically adjusted.

9. The hydraulic drive according to claim 1, wherein the hydraulic drive is configured with a control loop in which an actual variable is a measured high pressure, an actuating variable of the control loop is the predefined setpoint pressure of the pressure reducing valve, and a setpoint variable of the said control loop is the desired high pressure.

10. The hydraulic drive according to claim 1, wherein the hydraulic drive is configured as a horizontal drilling machine.

11. The hydraulic drive according to claim 1, wherein the control valve is configured to selectively connect the first feed connector to the actuating cylinder to adjust the displacement volume as a function of the predefined setpoint pressure.

12. A method for operating a hydraulic drive that comprises (i) a hydraulic motor configured to drive a drill, (ii) a main pump to which the hydraulic motor is connected in a closed hydraulic circuit via a first working line and a second working line, the main pump having a displacement volume that is steplessly adjustable, (iii) an actuating cylinder configured to adjust the displacement volume of the main pump, (iv) a control valve connected to the actuating cylinder, the control valve having a first feed connector and a first return connector, and (v) a pressure reducing valve having an outlet connector to which the first feed connector is connected, wherein the first feed connector is adjustable to a predefined setpoint pressure via the pressure reducing valve, and the hydraulic drive is configured such that the predefined setpoint pressure is set based on a desired high pressure in the closed hydraulic circuit, the method comprising:
setting the predefined setpoint pressure to a first high pressure for changing a part of the drill; and
setting the predefined setpoint pressure to a second high pressure for advancing of the drill.

* * * * *